United States Patent [19]

Miura et al.

[11] 4,322,157

[45] Mar. 30, 1982

[54] COPYING MACHINE

[75] Inventors: Shinji Miura, Kawasaki; Kazuo Aramaki, Yokohama, both of Japan

[73] Assignee: Ricoh Co., Ltd., Tokyo, Japan

[21] Appl. No.: 183,455

[22] Filed: Sep. 2, 1980

[30] Foreign Application Priority Data

Sep. 3, 1979 [JP] Japan ..... 54/112528

[51] Int. Cl.[3] ..... G03G 15/00

[52] U.S. Cl. ..... 355/14 C; 355/7; 355/40

[58] Field of Search ..... 355/14 R, 14 C, 7, 3 R, 355/40, 41; 354/3, 6

[56] References Cited

U.S. PATENT DOCUMENTS 3,872,462 3/1975 Lemelson ..... 354/76 X 4,042,962 8/1977 Yamaji ..... 355/3 R X 4,124,286 11/1978 Barasch ..... 355/14 R 4,167,324 9/1979 Wu ..... 355/7 X 4,255,040 3/1981 Weigl et al. ..... 355/3 R 4,268,164 5/1981 Yajima ..... 355/7 X

*Primary Examiner*—R. L. Moses

*Attorney, Agent, or Firm*—Oblon, Fisher, Spivak, McClelland & Maier

[57] ABSTRACT

In a copying machine, a predetermined part of image data read out of an original by an original reader is extracted and is temporarily stored as variable data to be edited in a first memory, while fixed data necessary for forming documents from the original are stored in a second memory, and data read out of the memories and new data inputted additionally by a data generator are combined selectively under the control of a control system to form the documents.

5 Claims, 15 Drawing Figures

COPYING MACHINE

BACKGROUND OF THE INVENTION

This invention relates to a copying machine having an image data editing function.

Recent copying machines are so designed as not only to copy an original but also to erase unnecessary parts of the original and to add new data to the original. That is, the copying machines provided recently have an image data editing function to reduce labor and time required for preparing a new original from the existing original.

Especially for instance in the case where a plurality of work slips different in contents are prepared for a plurality of sections in a department store according to a commodity delivery request slip prepared by a customer, the use of a copying machine having such an image data editing function is required in order to reduce or eliminate labor and time required for persons to write the data again.

A conventional copying machine of this type has been disclosed by Japanese patent application Laid-Open No. 59929/1979. In the conventional copying machine, a first original having variable data such as commodity names, prices and consignees the entry of which is required depending on the kinds of work slips and a second original having variable data such as consignors' names and addresses which are required for all of the work slips are used in combination in such a manner that the variable data are selected by using mask means in preparing the work slip to edit the data as required, thereby to form a plurality of work slips on one recording sheet.

However, the conventional copying machine is disadvantageous in the following points: As the data editing is optically carried out by using in combination fixed and variable mask members, the concerned construction is rather intricate, and it is impossible to write additional, new data. As the mask members must be suitably positioned to select variable data separately according to work slips, the operation is intricate and trouble some, and may sometimes be erroneous. For the conventional copying machine, it is necessary that different patterns, characters, etc. are printed on different work slips in advance. Even if, when a plurality of work slips are formed on one recording sheet, one work slip thus made has errors, then all of the work slips must be abandoned and it is required to form the work slips all over again.

SUMMARY OF THE INVENTION

In view of the foregoing, an object of this invention is to provide a copying machine having an image data editing function, in which work slips can be formed selectively individually or in combination on ordinary sheets on which nothing is printed, and additional, new data can be written in the work slips as desired.

Figure 1:
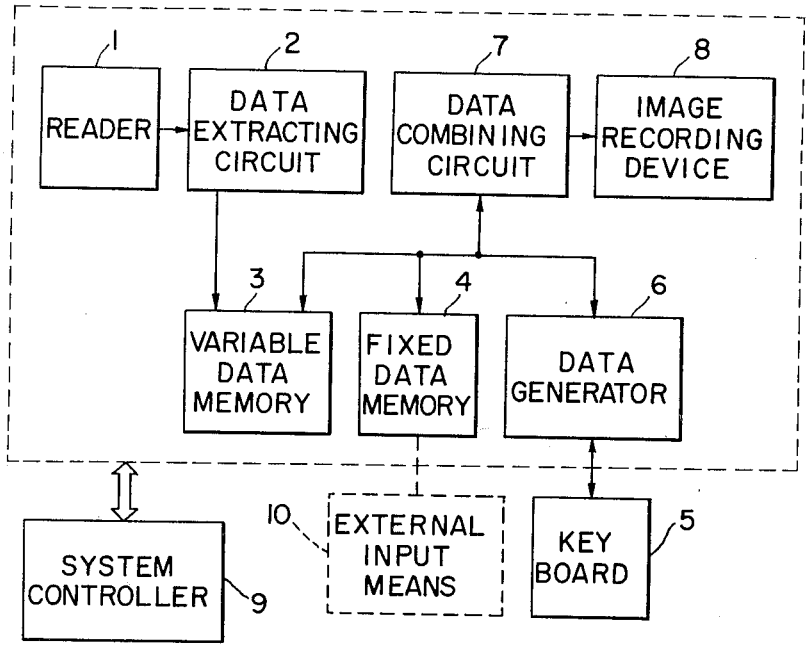
FIG. 1 is a block diagram showing one example of a copying machine according to this invention.
Figure 5:
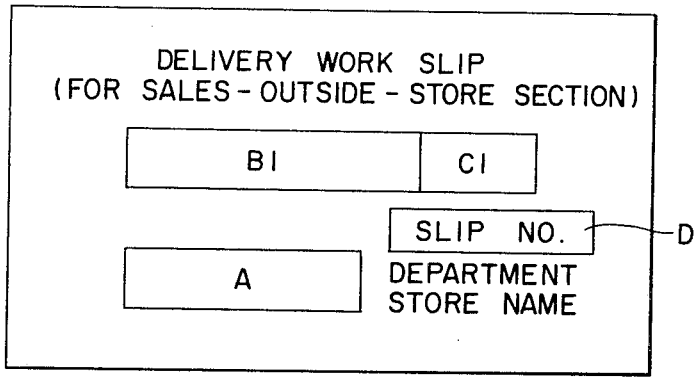
Figure 5:
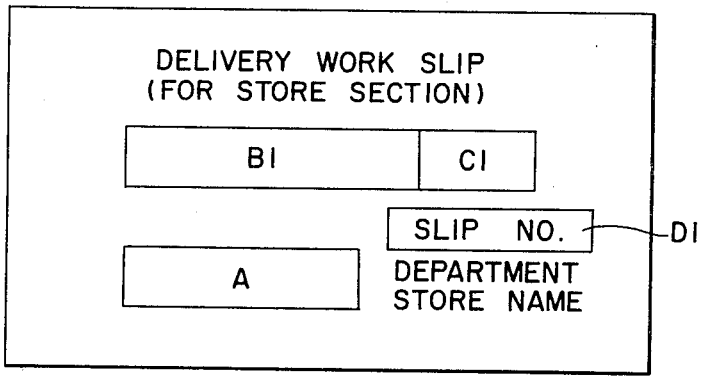
Figure 5:
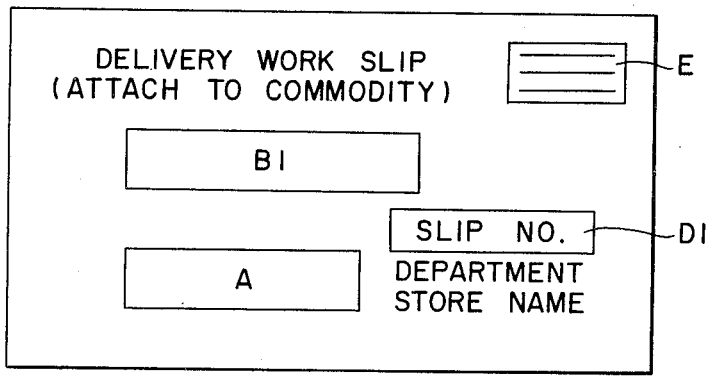
Figure 5:
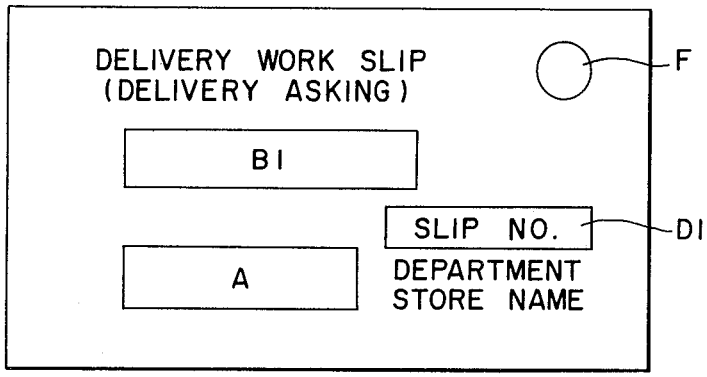
Figure 5:
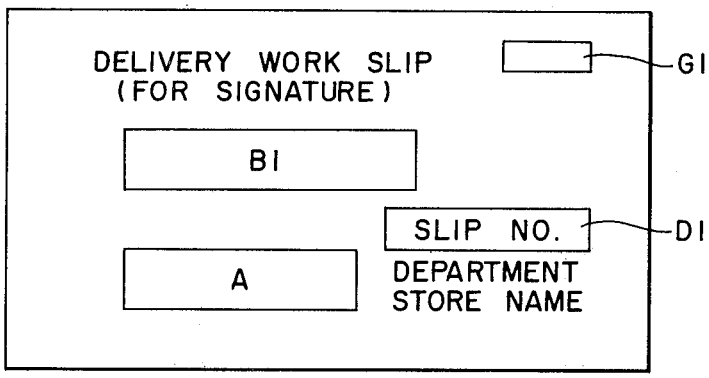
Figure 5:
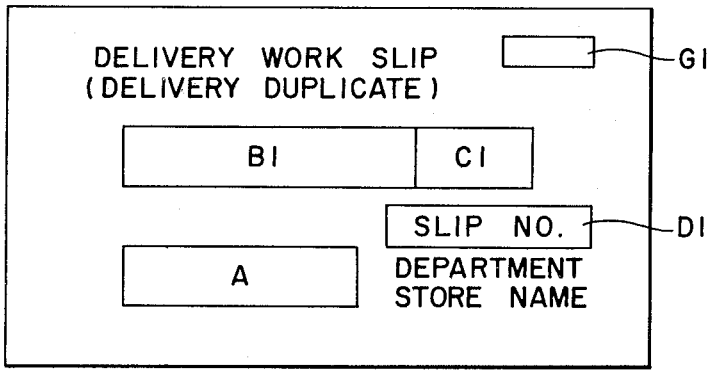
Figure 6:
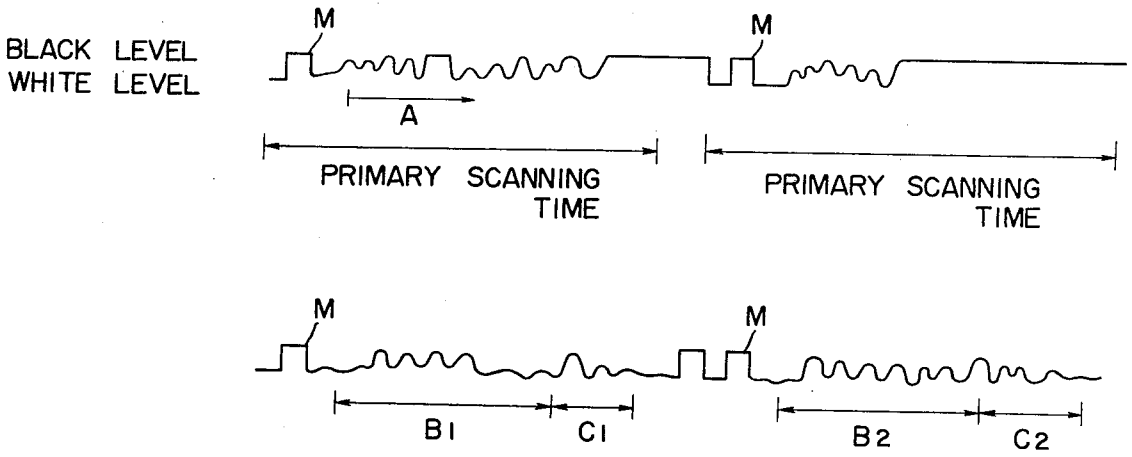
Figure 8:
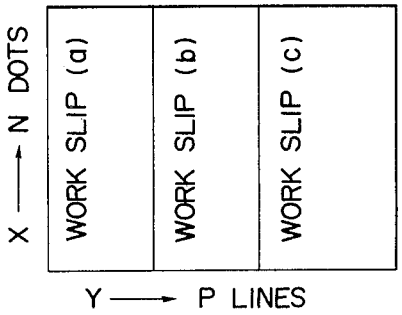
Figure 7:
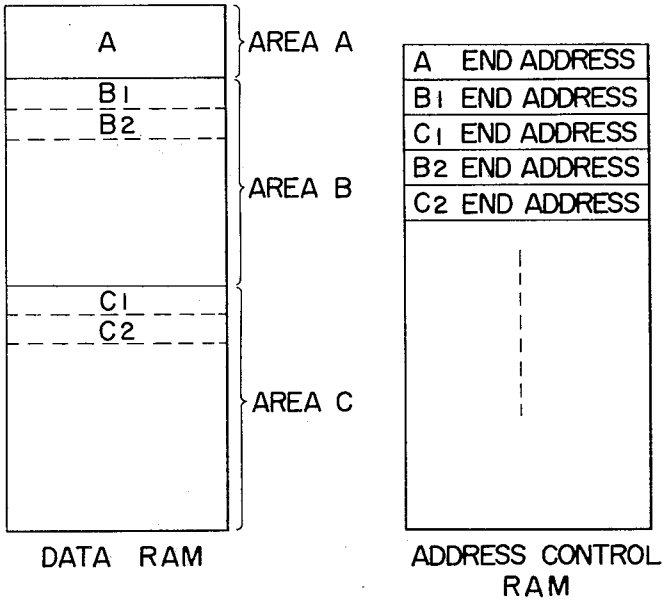

The parts (a) through (f) of FIG. 5 are diagrams showing a set of work slips which is formed from an original;

FIG. 6 is a diagram showing one example of the image data which is read by scanning an original;

FIG. 7 shows one example of data stored in a variable data memory in the copying machine in FIG. 1; and FIG. 8 is a diagram showing one example of the combination of work slips which are printed on one recording sheet.

DETAILED DESCRIPTION OF THE INVENTION

One preferred example of a copying machine according to this invention, as shown in FIG. 1, comprises: an original reading device 1 for optically scanning the surface of an original to read image data thereof; a data extracting circuit 2 for extracting the data of a particular portion out of the image data thus read and subjecting the data thus extracted to data compression; a variable data memory (RAM) 3 for temporarily storing the particular data thus extracted and subjected to data compression; a fixed data memory (ROM) 4 in which fixed data which are absolutely necessary among the data of a document or original to be copied have been stored; a data generator 6 for generating new data in response to external instructions issued by means of a key board 5; a data combining circuit 7 for suitably combining data generated by the data generator 6, variable data and fixed data to provide combination data; an image recording device 8 for permitting an image to be recorded according to the combination data; and a system controller (CPU) 9 for collectively controlling these units.

Figure 2:
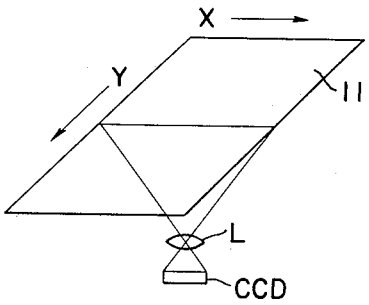
FIG. 2 is an explanatory diagram showing one example of an original reading device in the copying machine in FIG. 1.

One example of the original reading device 1 is as shown in FIG. 2. which employs a solid image pickup element, namely, a CCD line sensor. In the original reading device, an original surface 11 is irradiated by an irradiating system (not shown), and light reflected by the original surface 11 is introduced through a lens L to the CCD line sensor, so that image data for every line in the main scanning direction (X) are converted into an electrical signal, while the relative position of the original surface 11 and the CCD line sensor is shifted successively in the secondary scanning direction (Y), whereby the original image is read.

Figure 3:
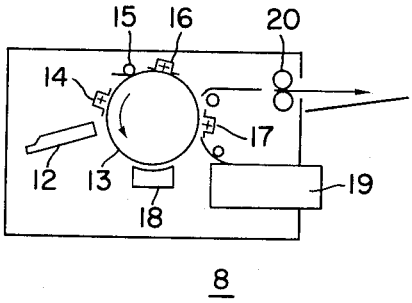
FIG. 3 is an explanatory diagram showing the arrangement of an image recording device in the copying machine in FIG. 1.

Shown in FIG. 3 is one example of the image recording device 8 employing exposure means 12 which is the combination of a cathode ray tube (CRT) and a focusing optical transmitter array (or an optical data transmitting path). The image recording device, as shown in FIG. 3, comprises: a photosensitive drum 13; a charger 14; a cleaner 15; a discharger 16; a transferring unit 17; a developing tank 18; a sheet supplying cassette 19; and a fixing roller 20.

The operation of the copying machine thus organized will be described with reference to the case where slips are formed in a department store.

Figure 4:
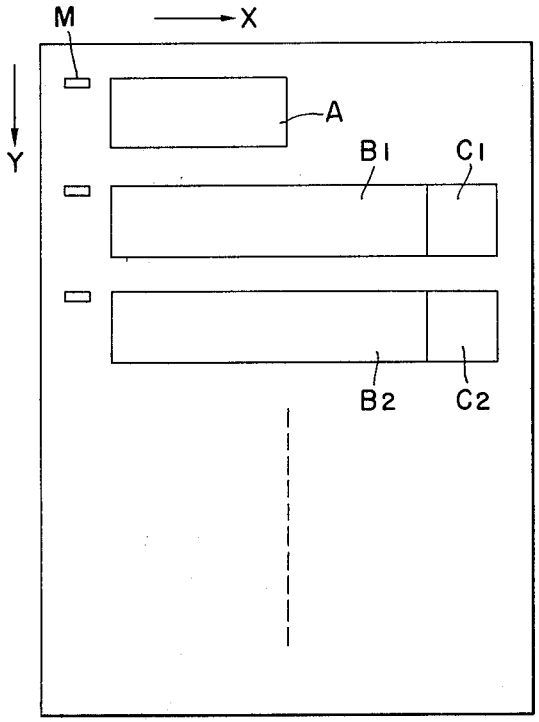
FIG. 4 is a diagram showing one example of an original.

FIG. 4 shows a delivery request slip which is an original in this case. In FIG. 4, reference character A designates a column where the address and name of a consignor are to be entered, $B_1$, $B_2$, . . . , columns for the names and numbers of commodities; and $C_1$, $C_2$, . . . , columns for the unit prices and carriage of the commodities. Thus, all data necessary for delivery can be entered in one delivery request slip. Address marks M are provided for the entry columns, respectively, as shown in FIG. 4.

The parts (a) through (f) of FIG. 5 show one set of work slips which are prepared for concerned sections in the department store according to the delivery request slip shown in FIG. 4.

The slip shown in the part (a) of FIG. 5 is for the sales-outside-store section, and among the entered data of the delivery request slip the data A, B and C (variable data) and a slip number D (new data) are entered in the slip. The slip shown in the part (b) of FIG. 5 is for the store section, and the same data as those of the slip shown in the part (a) are entered in the slip. Similarly, the data A, B and C and character data E such as "Thank you very much" (fixed data) are filled in the slip shown in the part (c) of FIG. 5, and the data A, B and D and a post office mark F (fixed data) are entered in the delivery asking slip shown in the part (d). Furthermore, the data A, B and D and a mechanical process mark G such as characters for an optical character reader (OCR) are filled in the signature slip shown in the part (e) of FIG. 5 in which the signature of a consignee is to be written, and the data A, B, C, D and G are entered in the delivery duplicate slip in the part (f) of FIG. 5.

In the copying machine according to the invention, various image editing operations are carried out according to the image data which are read by the reading device 1 out of an original which is the delivery request slip shown in FIG. 4 in this case, so that the various work slips shown in the parts (a) through (f) of FIG. 5 are formed by the image recording device 8. In this respect, it should be noted that image data such as characters "Delivery Slip", "For the Sales-Outside-Store Section", "Slip Number" and "Name of Department Store", and "Thank you very much (E)" or the various marks (F and G) have been stored in a ROM mode in the fixed data memory 4. Alternatively, these fixed data, after being subjected to data compression, may be stored in the memory 4 by using an external input means 10 in advance. For the ruled lines in the slips, the address positions where the ruled lines occur are stored as fixed data in the memory 4 in advance.

The slip number D handles as new data is preset in the data generator 6 by operating the key board 5 before preparation of the slips. The data generator 6 is so designed that the contents are automatically renewed by detecting a slip number whenever a set of slips is prepared.

The delivery request slip is placed on the contact glass plate of the original reading device 1, so that its image data are read by the latter 1. The image data thus read are applied to the data extracting circuit 2, where detecting the address marks M on the slip, dot-counting in the primary scanning direction and line-counting in the secondary scanning direction are carried out as shown in FIG. 6, whereby the data in the predetermined region, i.e. the variable data A, B and C are extracted. The variable data A, B and C thus extracted are subjected to data compression (not only one-dimensionally but also two-dimensionally) according to their lengths in the primary scanning direction, and are then applied to the variable data memory 3, where they are temporarily stored. In this operation, first the variable data A is held in the area A of the data RAM, and the end address of the RAM holding the data A is stored in the address control RAM, as shown in FIG. 7. The variable data $B_1$ and $C_1$ are read successively within the same primary scanning period. The variable data $B_1$, after being compressed, is held in the area B of the data RAM, and the variable data $C_1$, after being compressed, is held in the area C of the data RAM, while the end addresses of the data $B_1$ and $C_1$ are stored in the address control RAM. In a manner as described above, the variable data A, $B_1$, $B_2$, . . . , $C_1$, $C_2$, . . . read out of the entire surface of the delivery request slip are stored in the variable data memory 3.

After the variable data A, B and C have been read out of the delivery request slip, the system controller 9 issues instruction signals for calling variable data and fixed data necessary for formation of a set of slips from the delivery request slip to the data memories 3 and 4. The variable and fixed data thus called are delivered to the data combining circuit, in which, after being subjected to data expansion, they are combined into a series of primary scanning signals. On the other hand, ruled line data called out of the fixed data memory are inserted, as a dot signal, in the primary scanning signals upon coincidence of the address. The system controller 9 issues an operation instruction signal to the data generator 6 with predetermined timing, so that the numerical data of the slip number is inserted, as a dot signal, in the primary scanning signals by the data combining circuit 7.

The image data signals which are formed by the data combining circuit 7 for every primary scanning line according to the data required for the slips are applied to the image recording device 8, where the data are recorded on the slips, respectively. In this connection, the copying machine of the invention is so designed that it can record a single or a plurality of slips on one recording sheet selectively according to instruction signals applied externally thereto. FIG. 8 shows three slips, shown in the parts (a), (b) and (c) of FIG. 5, which are copied on one recording sheet. The output data of each slip is positioned in an address mode by resolving the entire area of the recording sheet with N dots in the primary scanning direction and with P lines in the secondary scanning direction.

As is apparent from the above description, in the copying machine capable of editing image data according to the invention, a predetermined part of the image data which is read by the original reading device is extracted by the data extracting circuit and is temporarily stored as variable data to be edited in the rewritable memory, fixed data necessary for preparing documents are stored in the calling-only memory in advance, and the means for writing additional data is provided, so that calling the data out of the memories and combining the data thus called and the additional data written are collectively controlled by the system controller, thereby to achieve image data editing as desired. Thus, with the copying machine, a plurality of documents different in content can be copied on ordinary sheets on which nothing has been printed, merely by setting an original thereon. The copying machine, being excellent in operability, has a wide range of application, and is applicable especially to the case where a plurality of slips are prepared for a plurality of sections in a department store according to a commodity delivery request slip.

What is claimed is:

1. A copying machine which comprises:

original reading means for reading image data out of an original;

data extracting means for extracting a predetermined part of said image data thus read;

first memory means capable of rewrite data, for temporarily storing said predetermined part of said image data as variable data to be edited;

second memory means in which fixed data required for forming documents to be copied out by said copying machine have been stored in advance;

a data generator for writing additional, new data; and a system controller for collectively controlling calling data out of said memory means and combining said data called out of said memory means and additional, new data written by said input means, whereby image data are edited as required.

2. A copying machine as claimed in claim 1, which further comprises: data combining means for combining data read out of said memory means.

3. A copying machine as claimed in claim 1, in which said first memory means is a random access memory, said second memory means is a read-only memory, and said system controller is a central processing unit.

4. A copying machine as claimed in claim 1, which further comprises: key board means for issuing external instructions to a data generator.

5. A copying machine as claimed in claim 1, which further comprises: an external input means connected to a memory to store fixed data in advance.

* * * * *